US011739566B2

(12) United States Patent
Zhang et al.

(10) Patent No.: US 11,739,566 B2
(45) Date of Patent: Aug. 29, 2023

(54) LOCKING DEVICE FOR SLIDING DOOR

(71) Applicant: ASSA ABLOY ENTRANCE SYSTEMS AB, Landskrona (SE)

(72) Inventors: Jeff Zhang, Jiangsu (CN); Jack Liu, Jiangsu (CN)

(73) Assignee: Assa Abloy Entrance Systems AB, Landskrona (SE)

( * ) Notice: Subject to any disclaimer, the term of this patent is extended or adjusted under 35 U.S.C. 154(b) by 293 days.

(21) Appl. No.: 16/959,393

(22) PCT Filed: Dec. 18, 2018

(86) PCT No.: PCT/EP2018/085405
§ 371 (c)(1),
(2) Date: Jun. 30, 2020

(87) PCT Pub. No.: WO2019/137752
PCT Pub. Date: Jul. 18, 2019

(65) Prior Publication Data

US 2021/0032905 A1 Feb. 4, 2021

(30) Foreign Application Priority Data

Jan. 10, 2018 (CN) ..... 201810024268.7

(51) Int. Cl.
*E05B 65/00* (2006.01)
*E05B 65/08* (2006.01)
*E05F 15/56* (2015.01)

(52) U.S. Cl.
CPC ..... *E05B 65/08* (2013.01); *E05F 15/56* (2015.01); *E05Y 2201/22* (2013.01);
(Continued)

(58) Field of Classification Search
CPC ..... E05C 17/62; E05B 65/08; E05D 13/04; E05F 15/56; E05F 15/643; E05F 15/635;
(Continued)

(56) References Cited

U.S. PATENT DOCUMENTS 4,763,385 A * 8/1988 Furch ..... E05F 3/106 16/64
5,285,596 A 2/1994 Kinsey
(Continued)

FOREIGN PATENT DOCUMENTS

CH 385067 2/1965
CN 208089032 11/2018
(Continued)

OTHER PUBLICATIONS

International Search Report and Written Opinion mailed in PCT/EP2018/085405 dated Mar. 25, 2019.
(Continued)

*Primary Examiner* — Chi Q Nguyen
(74) *Attorney, Agent, or Firm* — Wissing Miller LLP

(57) ABSTRACT

A lock device for locking the sliding door comprises a first lock portion and a transmission portion. The transmission portion may move along relative to the first lock portion a predetermined path, so that the transmission portion may bring the sliding door to move along the predetermined path to open or close the sliding door. The transmission portion has a plurality of successively arranged mating portions for locking with the first lock portion. The first lock portion has a first position in which the first lock portion is locked with the transmission portion and a second position in which the first lock portion is released from the transmission portion. The transmission portion may be locked in different positions along the predetermined path by matching the first lock
(Continued)

portion 110 with different mating portions, so that the sliding door can be locked in different positions.

32 Claims, 3 Drawing Sheets

(52) U.S. Cl.
CPC ..... *E05Y 2201/42* (2013.01); *E05Y 2201/652* (2013.01); *E05Y 2201/682* (2013.01); *E05Y 2201/686* (2013.01); *E05Y 2201/71* (2013.01); *E05Y 2900/132* (2013.01)

(58) Field of Classification Search
CPC ..... E05Y 2201/686; E05Y 2900/132; E05Y 2201/652; E05Y 2201/42; E05Y 2201/648; E05Y 2201/22; E05Y 2201/71; E05Y 2201/234; E05Y 2201/682
USPC ..... 49/363, 362; 70/95, 96, 98, 102
See application file for complete search history.

(56) References Cited

U.S. PATENT DOCUMENTS 5,351,441 A * 10/1994 Hormann ..... E05F 15/635 74/89.17
6,007,117 A * 12/1999 Spindler ..... E05B 83/36 292/216
6,079,767 A * 6/2000 Faubert ..... E05F 15/646 296/155
6,139,073 A * 10/2000 Heffner ..... E05B 83/40 292/201
6,256,930 B1 * 7/2001 Faubert ..... E05F 15/40 49/362
6,446,389 B1 * 9/2002 Heffner ..... E05F 15/652 49/118
7,024,725 B2 * 4/2006 Homberg ..... E05F 3/102 74/462
8,136,299 B2 * 3/2012 Inage ..... E05C 19/16 49/118
9,340,215 B2 * 5/2016 Masuda ..... E05B 83/40
10,494,852 B2 * 12/2019 Fujita ..... B61D 19/02
2002/0194784 A1 * 12/2002 Stojc ..... E05B 65/0829 49/118
2010/0308624 A1 * 12/2010 Juga ..... E05B 13/004 296/202

FOREIGN PATENT DOCUMENTS

| | | |
|---|---|---|
| DE | 4415708 | 7/1995 |
| DE | 19700859 | 7/1998 |
| FR | 2853683 | 10/2004 |
| WO | 2010121920 | 10/2010 |

OTHER PUBLICATIONS

First Office Action mailed in CN 2018100242687 dated Apr. 11, 2019.

* cited by examiner

LOCKING DEVICE FOR SLIDING DOOR

This application is a 371 of PCT/EP2018/085405 filed on Dec. 18, 2018, published on Jul. 18, 2019 under publication number WO 2019/137752, which claims priority benefits from Chinese Patent Application No. 20180024268.7, filed on Jan. 10, 2018, the disclosure of which is incorporated herein by reference.

TECHNICAL FIELD

The present disclosure relates to the technical field of locks, especially a locking device for a sliding door.

BACKGROUND

Sliding doors are widely used in residences, rail transit, and commercial buildings and other places. A sliding door could be a single-leaf or multi-leaf door capable of sliding motion. The sliding door can be opened or closed through the sliding motion of the door. For the sake of safety and ease of use, locks are usually used to lock or unlock the sliding door.

DE4415708C1 discloses a locking device for locking a drive motor sliding door. Said sliding door can be a double-leafed or even a single-leaf door, wherein the door leaves are moved over rollers on a running rail in the horizontal direction. A lock is therefore required for this type of sliding door to be securely locked in its closed position, so that the door cannot be opened with violence from outside, such as after the closing time of the building. The two door leaves in the closed position are automatically locked by a device which is located on running carriages which move towards each other with their ends. The device comprises a locking hook, a locking bolt, a driver piece and a driver pin. The driver piece is connected to the drive belt at the upper and lower stub end by a fixture. In the driver piece an L-shape recess is provided, in which the driver pin engages. The advantage of the above-described locks is that even in the de-energized state, a door of the aforementioned type, whether single- or double-leaf, can be securely locked. The engagement of the driver piece and the driver pin could drive the locking hook to rotate to release the locking bolt, thus the drive belt.

Obviously, the lock in DE4415708C1 is used to lock the sliding door(s) in a closed position. If the sliding door is slide to a half-open state, however, then the lock disclosed in this document cannot be used to lock the sliding door.

US 2007/0180772A1 discloses a sliding door system, comprising: a transom; at least one door leaf slidably connected with the transom; an endless traction mechanism tension-resistantly connected to the at least one door leaf; and a drive device comprising a driven pulley for driving the endless traction mechanism. The sliding door system further comprises a housing for accommodating the transom and the driven pulley. The driven pulley guides the endless traction mechanism and is provided with a flange facing the housing, a locking element on the flange, a complementary locking element supported by the housing, and an electromechanical actuation device received in the housing. The electromechanical actuation device is operable to cause the complementary locking element to abut against the locking element, thereby locking the at least one door leaf relative to the transom.

Similarly, the complementary locking element in US2007180772A1 is located in a specific position when the door leaf is closed and the locking element could lock the sliding door(s) only in this specific position. Had the door leaf been slid into a half-open position, the locking elements mentioned in US2007180772A1 would not be able to lock the sliding door.

CN101275450A discloses a master coupler lock for a sliding door (or window) and a lock comprising the same. The master coupler lock comprises a handle and a case, wherein the case is equipped with a driving gear inside and the handle is axially connected with the driving gear through the case. The driving gear is geared with a first driving strip and a second driving strip, wherein the first driving strip is fixedly equipped with a first lock catch component at one end and the second driving strip is fixedly equipped with a second lock catch component at one end. The first driving strip is further equipped with a driving strip locking mechanism. The lock comprises a panel, the master coupler lock and a slavery coupler lock. Since the master coupler lock is equipped with the driving strip locking mechanism, after the master coupler lock is opened, the driving strip locking mechanism can lock, but not move, the first driving strip, preventing the lock catch components from being locked due to careless opening of the master coupler lock of the sliding door. Accordingly, collision of the lock catch components and the door or window frame and consequential damage of the master coupler lock can be avoided.

The type of the lock in CN101275450A is a hook lock, which is a commonly used mechanical lock. When using the hook lock to lock a sliding door, the hook lock, and in turn the sliding door, can be easily opened with a large force applied on the hook lock, causing a potential safety hazard. Moreover, the sliding door may be easily subject to disturbance and thus shaking when in a locked state, as the hook lock can hardly maintain a stable closed state of the sliding door.

CN105545139B discloses an automatic door sliding system. The automatic door sliding system comprises a cross beam, a driving mechanism arranged on the cross beam and a limiting mechanism. The driving mechanism is connected with a sleeve component. A door leaf is connected through a door carrying frame. A guide locking block is arranged on the cross beam. The driving mechanism comprises a lead screw driven by a motor and a nut component comprising a transmission frame, a nut sleeved on the lead screw, and a follow-up part fixed on the nut. The nut is mounted in the transmission frame which is connected with the sleeve component. The lead screw drives the nut component to perform a reciprocating motion in the axial direction of the lead screw. In the forward rotating process of the lead screw, the follow-up part, when contacted with the guide locking block, moves to the limiting mechanism under the guidance of the upper surface of the guide locking block until stopped by the limiting mechanism, and then rotates along with the lead screw to enter a space between a side surface of the guide locking block and the limiting mechanism to be locked. And when the lead screw reversely rotates, the follow-up part reversely rotates along with the lead screw to detach from the limitation of the guide locking block to be unlocked, and moves in the axial direction of the lead screw.

The lock in CN105545139B could only lock the sliding door in a closed position is of the sliding door. If sliding the door leaf of the sliding door to a half-open position, then the lock in CN105545139B cannot lock the sliding door.

SUMMARY OF THE INVENTION

In view of the above, it is necessary to provide an improved lock device for locking the sliding door, which solves or at least partially alleviate the problem mentioned above.

A lock device for locking a sliding door, characterized in that, the lock device comprises: a first lock portion; and a transmission portion, wherein the transmission portion is used to drive a first door leaf of the sliding door to move and is capable of moving relative to the first lock portion move relative to the first lock portion along a predetermined path. The transmission portion has a plurality of successively arranged mating portions for locking with the first lock portion, and the first lock portion has a first position in which the first lock portion is locked with the transmission portion and a second position in which the first lock portion is released from the transmission portion. The transmission portion could be locked in different positions along the predetermined path by matching the first lock portion with different mating portions.

The lock device mentioned above comprises a first lock portion and a transmission portion. The transmission portion may move relative to the first lock portion along a predetermined path, so that the transmission portion may bring the sliding door to move along the predetermined path to open or close the sliding door. The transmission portion has a plurality of successively arranged mating portions for locking with the first lock portion. The first lock portion has a first position in which the first lock portion is locked with the transmission portion and a second position in which the first lock portion is released from the transmission portion. The transmission portion may be locked in different positions along the predetermined path by matching the first lock portion with different mating portions, so that the sliding door can be locked in different positions. Through the technical solution mentioned above, the sliding door may be locked not only in a fully open position or a fully closed position of the sliding door, but also in any partly-open position of the sliding door, so that the sliding door could be locked in the partly-open state stably.

In one of the embodiments, the transmission portion of the lock device can bring the mating portions to move along a straight path relative to the first lock portion, and the first lock portion can move along a path which is at an angle with the straight path, so that the first lock portion could be locked with or released from the mating portions.

In one of the embodiments, the first lock portion and the mating portions of the lock device can match with each other in a form of one-way relative motion, so that when the first lock portion is matched with the mating portions, the mating portions may move along a single direction relative to the first lock portion.

In one of the embodiments, the first lock portion of the lock device comprises a plurality of first teeth and first tooth sockets formed between the adjacent first teeth, wherein the first teeth and the first tooth sockets could be engaged with the corresponding tooth sockets and corresponding teeth of the transmission portion, respectively, so that the transmission portion is locked.

In one of the embodiments, each of the first teeth has, along tooth thickness, a first surface and a second surface opposite to the first surface, wherein the first surface forms an angle with a direction perpendicular to the movement direction of the first door leaf in the range of 20°~30°; and wherein the second surface has a first limitation part in the movement direction of the first door leaf, the first limitation part being used to limit the movement of the transmission portion.

In one of the embodiments, the angle between the first surface and the direction perpendicular to the movement direction of the first door leaf is 23°.

In one of the embodiments, when the first lock portion transfers between the first position and the second position, the first lock portion moves close to or away from the transmission portion; the lock device further comprises a first guiding assembly, wherein the first guiding assembly is used to guide the movement direction of the first lock portion when the first lock portion moves close to or away from the transmission portion.

In one of the embodiments, the first guiding assembly comprises a first guiding pin and a second guiding pin, the positions of the first guiding pin and the second guiding pin being fixed;

the first lock portion is provided with a first guiding slot and a second guiding slot, wherein the first guiding pin is located in the first guiding slot and the second guiding pin is located in the second guiding slot; and, the extending direction of the first guiding slot is parallel to that of the second guiding slot; and the first guiding pin and the second guiding pin can guide the movement of the first lock portion, so that when the first guiding pin moves in the extending direction of the first guiding slot relative to the first lock portion and the second guiding pin moves in the extending direction of the second guiding slot relative to the first lock portion, the first lock portion moves close to or away from the transmission portion.

In one of the embodiments, the angle formed between the extending direction of the first guiding slot and the movement direction of the transmission portion ranges from 40° to 60°.

In one of the embodiments, the angle formed between the extending direction of the first guiding slot and the movement direction of the transmission portion is 50°.

In one of the embodiments, the lock device further comprises a first linkage assembly which could bring the first lock portion to move with the guiding of the first guiding assembly.

In one of the embodiments, the first linkage assembly comprises a rotatable first linkage portion and a second linkage portion, wherein the first linkage portion is provided with a fifth guiding slot, in which the second linkage portion is located, the second linkage portion being fixedly connected with the first lock portion. When the first linkage portion rotates, the second linkage portion can be brought to move along, so that the second linkage portion moves in the extending direction of the fifth guiding slot relative to the first linkage portion, thereby bringing the first lock portion to move with the guiding of the first guiding assembly.

In one of the embodiments, the transmission portion is used to drive a second door leaf of the sliding door to move. The lock device further comprises a second lock portion, and the transmission portion could move relative to the second lock portion along a predetermined path. The transmission portion has a plurality of successively arranged mating portions for locking with the second lock portion, and the second lock portion has a third position in which the second lock portion is locked with the transmission portion and a fourth position in which the second lock portion is released from the transmission portion. The transmission portion can thus be locked in different positions along the predetermined path by matching the second lock portion with different mating portions.

In one of the embodiments, the transmission portion is an annular transmission belt; or, the transmission portion comprises a first portion and a second portion independent of each other, wherein the first portion is used to match with the first lock portion, and the second portion is used to match with the second lock portion.

In one of the embodiments, the transmission portion can bring the mating portions to move relative to the second lock portion along a straight path, and the second lock portion may move along a path which is at an angle with the straight path, so that the second lock portion can be locked with or released from the mating portions.

In one of the embodiments, the second lock portion and the mating portions can match with each other in a form of one-way relative motion, so that when the second lock portion is matched with the mating portions, the mating portions can move along a single direction relative to the second lock portion.

In one of the embodiments, the second lock portion comprises a plurality of second teeth and the second tooth sockets formed between the adjacent second teeth, wherein the second teeth and the second tooth sockets can be engaged with the corresponding tooth sockets and corresponding teeth of the transmission portion, so that the transmission portion is locked.

In one of the embodiments, each tooth has a third surface and a fourth surface opposite to the third surface in the direction of tooth thickness, wherein the third surface forms an angle with a direction perpendicular to the movement direction of the second door leaf ranged from 20° to 30°. The fourth surface has a second limitation part in a movement direction of the second door leaf, the second limitation part being used to limit the movement of the second teeth.

In one of the embodiments, the angle formed between the third surface and the direction perpendicular to the sliding direction of the second door leaf is 23°.

In one of the embodiments, when the second lock portion transfers between the third position and the fourth position, the second lock portion moves close to or away from the transmission portion. The lock device further comprises a second guiding assembly, the second guiding assembly being used to guide the movement direction of the second lock portion when the second lock portion moves close to or away from the transmission portion.

In one of the embodiments, the second guiding assembly comprises a third guiding pin and a fourth guiding pin, the positions of the third guiding pin and the fourth guiding pin being fixed;

the second lock portion is provided with a third guiding slot and a fourth guiding slot, wherein the third guiding pin is located in the third guiding slot and the fourth guiding pin is located in the fourth guiding slot; and, the extending direction of the third guiding slot is parallel to that of the fourth guiding slot;

the third guiding pin and the fourth guiding pin can guide the movement of the second lock portion, so that when the third guiding pin moves in the extending direction of the third guiding slot relative to the second lock portion and the fourth guiding pin moves in the extending direction of the fourth guiding slot relative to the second lock portion, the second lock portion moves close to or away from the transmission portion.

In one of the embodiments, the angle formed between the extending direction of the third guiding slot and the movement direction of the transmission portion ranges from 40° to 60°.

In one of the embodiments, the angle formed between the extending direction of the third guiding slot and the sliding direction of the transmission portion is 50°.

In one of the embodiments, further comprises a second linkage assembly which could bring the second lock portion to move with the guiding of the second guiding assembly.

In one of the embodiments, the second linkage assembly comprises a rotatable third linkage portion and a fourth linkage portion, wherein the third linkage portion is provided with a sixth guiding slot in which the fourth linkage portion is located, the fourth linkage portion being fixedly connected with the second lock portion. When the third linkage portion rotates, the fourth linkage portion is brought to move along, so that the fourth linkage portion moves in the extending direction of the sixth guiding slot relative to the third linkage portion, thereby bringing the second lock portion to move with the guiding of the second guiding assembly.

In one of the embodiments, the lock device further comprises a first pin, wherein the first linkage portion is fixedly connected with the third linkage portion, the fifth guiding slot is located on one side of the first pin and the sixth guiding slot is located on the other side of the first pin, the fifth guiding slot and the sixth guiding slot having the same extending direction. When the first linkage portion and the third linkage portion rotate about the first pin, respectively, the second linkage portion and the fourth linkage portion move in opposite directions simultaneously, so that when the first lock portion is locked with the transmission portion, the second lock portion is also locked with the transmission portion simultaneously.

In one of the embodiments, the lock device further comprises a first supporting portion, on which the first pin is provided. The position of the first pin on the first supporting portion is adjustable, allowing adjusting the positions of the first linkage portion and the third linkage portion so as to adjust the positions of the first lock portion and the second lock portion.

In one of the embodiments, the lock device further comprises a driving portion used to drive the first linkage portion and the third linkage portion to rotate.

In one of the embodiments, the first linkage portion and the third linkage portion may be formed integrally.

In one of the embodiments, the driving portion is a solenoid valve.

In one of the embodiments, the type of locking may be: fail-safe locking, fail secure locking or bi-stable locking.

A sliding door system, which comprises the lock device in any one of technical solutions mentioned above, wherein one or more door leaves are fixedly connected to the transmission portion.

The lock device of the sliding door system mentioned above comprises a first lock portion and the transmission portion. The transmission portion may move relative to the first lock portion along the predetermined path, so that the transmission portion may bring the sliding door to move along the predetermined path to open or close the sliding door. The transmission portion has a plurality of successively arranged mating portions for locking with the first lock portion. The first lock portion has a first position in which the first lock portion is locked with the transmission portion and a second position in which the first lock portion is released from the transmission portion. The transmission portion may be locked in different positions along the predetermined path by matching the first lock portion with different mating portions, so that the sliding door can be locked in different positions. Through the technical solution mentioned above, the sliding door may be locked not only in a fully open position or a fully closed position of the sliding door, but also in any partly-open position of the sliding door, so that the sliding door could be locked in the partly-open state stably.

DETAILED DESCRIPTION OF EMBODIMENTS

Detailed description will be given below with referral to the accompanying figures to facilitate understanding of the present disclosure. Preferred embodiments are shown in the figures. However, the present disclosure may be implemented in a variety of forms and not limited to the embodiments described herein. On the contrary, the purpose of providing these embodiments is merely for illustration and better comprehension of the present disclosure.

It should be noted that, a portion, when being referred to as being "fixed to" another portion, may be directly on the another portion or there may be an intermediate portion in between. Similarly, a portion. when being referred to as being "connected to" another portion. may be directly on the another portion or there may be an intermediate portion in between. The terms "vertical", "horizontal", "left", "right" and the like as used herein are for illustrative purposes only and do not intended to limit the ways of implementation thereto.

Unless otherwise defined, all technical and scientific terms used herein have the same meaning as commonly understood by an ordinary skilled person in the art to which this disclosure belongs. The terms used herein in the specification of the present disclosure is for the purpose of describing the particular embodiments only and is not intended to limit the present disclosure. As used herein, the term "and/or" includes any and all combinations of one or more of the associated listed items.

Figure 2:
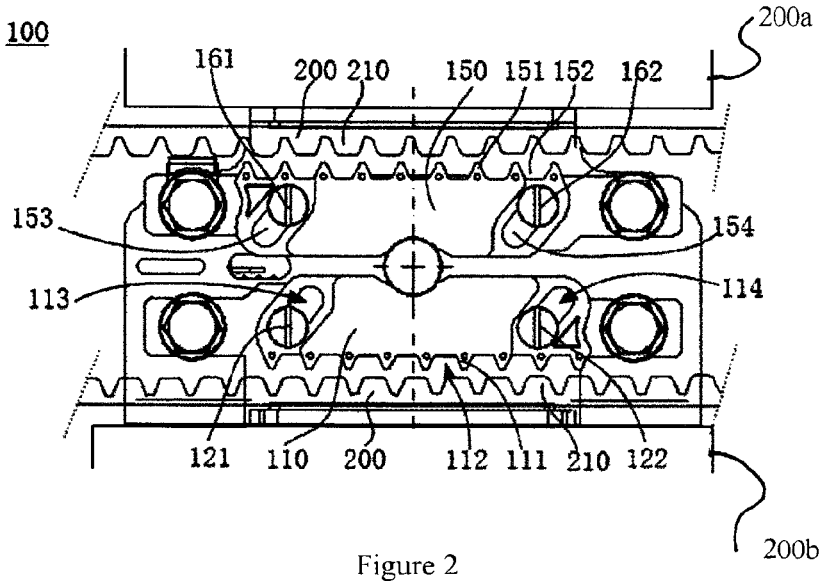
FIG. 2 is a schematic diagram showing the position relationships between the first locking portion and the transmission portion and between the second locking portion and the transmission portion, respectively, of the locking device shown in FIG. 1.

In an embodiment as shown in FIG.2, a lock device 100 is used to lock a sliding door 200*a*, 200*b*. The lock device 100 comprises a first lock portion 110 and a transmission portion 200. The transmission portion 200 can move relative to the first lock portion 110 along a predetermined path, so that the transmission portion 200 can bring the sliding door to move along the predetermined path to open or close the sliding door. The transmission portion 200 has a plurality of successively arranged mating portions for locking with the first lock portion 110. The first lock portion 110 has a first position in which the first lock portion 110 is locked with the transmission portion 200 and a second position in which the first lock portion 110 is released from the transmission portion 200. The transmission portion 200 may be locked in different positions along the predetermined path by matching the first lock portion 110 with different mating portions.

In particular, the sliding door usually comprises one or more door leaves. For example, a first door leaf 200*a* of the sliding door, may move as driven by the transmission portion 200, so as to cause the first door leaf to move in a direction of opening or closing the door. When the first lock portion 110 is in the second position, the first lock portion 110 releases the transmission portion 200, so that the transmission portion 200 could move along the predetermined path. The predetermined path refers to a movement path of the transmission portion 200 when it is driven. Along the predetermined path, the transmission portion 200 may bring the first door leaf to move in the opening or closing direction. When the transmission portion 200 moves along the predetermined path, the plurality of mating portions of the transmission portion 200 move synchronously with the transmission portion 200, so that the different mating portions could pass the first lock portion 110 successively, allowing the different mating portions to match with the first lock portion 110, respectively. When the first lock portion 110 move to the first position, it could match with the mating portions and lock the transmission portion 200. When different mating portions lock with the first lock portion 110, the transmission portion 200 is in different positions of the predetermined path, so that the transmission portion 200 could be locked in different positions of the predetermined path. After the transmission portion 200 is locked, it will no longer be able to drive the first door leaf to move, so that the first door leaf could be locked in any position along the travel range of the first door leaf. Therefore, by providing the first lock portion 110, the first door leaf could be locked not only in a fully open position or a fully closed position, but also in any partly-open position thereof, so that the first door leaf of the sliding door could be locked in the partly-open state stably.

In particular, the transmission portion 200 may be a transmission portion such as a transmission belt, a transmission rail and the like. For example, the transmission portion 200 may be a transmission belt, and the first door leaf is fixedly connected to the transmission belt. Accordingly, the transmission belt in motion will drive the movement of the first door leaf. The first lock portion 110 could comprise a plurality of clips and the mating portions may be in the form of hooks which match with the clips. When the transmission belt moves and brings the first door leaf to move, so will the plurality of hooks on the transmission belt. The first lock portion 110 can lock different hooks on the transmission belt via the clips, to inhibit the transmission belt from moving, thereby locking the first door leaf in different positions. As a result, it is possible to lock the first door leaf in any position along the travel range of the first door leaf.

In one of the embodiments, the transmission portion 200 can bring the mating portions to move relative to the first lock portion 110 along a straight path. That is to say, the first door leaf can move along the straight path together with the transmission portion 200. The first lock portion 110 can move along a path which is at an angle with the straight path. Due to the angle formed between the movement paths of the first lock portion 110 and the transmission portion 200, which may be a sharp angle or an obtuse angle, the first lock portion 110 may move towards or away from the transmission portion 200, causing the first lock portion 110 to lock with or separate from the mating portions and thus lock or release the transmission portion 200. Since the transmission portion 200 can bring the mating portions to move relative to the first lock portion 110 along the straight path, several different mating portions can pass the first lock portion 110 successively so that the different mating portions can match with the first lock portion 110. When different mating portions match with the first lock portion 110, the transmission portion 200 is located in different positions of the predetermined path, so that the transmission portion 200 can be locked in different positions of the predetermined path.

In one of the embodiments, the first lock portion 110 and the mating portions can match with each other in the way of one-way relative motion. In other words, when the first lock portion 110 matches with the mating portions, the mating portions can move in a single direction relative to the first lock portion 110. The single direction may be a direction in which the first door leaf closes. In other words, when the first lock portion 110 marches with the mating portions, the mating portions can only move along the closing direction of the first door leaf and cannot move along the opening direction of the first door leaf, so that the sliding door cannot be opened when locked, providing a good function of thievery and robbery prevention.

Referring to an embodiment shown in FIG. 2 to FIG. 5, the mating portions comprise a plurality of teeth 210 and tooth sockets between adjacent teeth 210. The first lock portion 110 comprises a plurality of first teeth 111, with a tooth socket 112 formed between adjacent first teeth 111. When the first lock portion 110 is in the second position, the first lock portion 110 is separated from the transmission portion 200, releasing the transmission portion 200 to cause the transmission portion 200 to move along the predetermined path. When the transmission portion 200 moves along the predetermined path, the teeth 210 and the tooth sockets of the transmission portion 200 move as well. When the first lock portion 110 moves to the first position, the first lock portion 110 is engaged with the transmission portion 200, so that the teeth 210 can be blocked by the first teeth 111, thereby locking the transmission 200. Since the transmission portion 200 can move along the predetermined path, the different teeth 210 of the transmission portion 200 can pass the first lock portion 110 successively to be engaged with the first lock portion 110. When different teeth 210 are engaged with the first lock portion 110, the transmission portion 200 may be locked in different positions. By providing a plurality of first teeth 111 and first tooth sockets 112 of the first lock portion 110, the first lock portion 110 can be engaged with the transmission portion 200, which facilitates the first teeth 111 to block the teeth 210 of the transmission portion 200 so as to lock the transmission portion 200, thereby locking the first door leaf of the sliding door. By using the transmission belt with teeth 210 and tooth sockets as the transmission portion 200, when the transmission portion 200 moves, the plurality of teeth of the transmission portion 200 can pass the first lock portion 110 successively to lock the transmission portion 200 in different positions.

Figure 4:
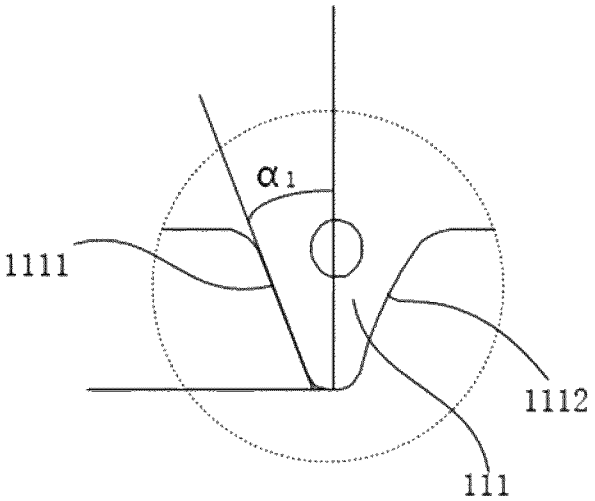
FIG. 4 is an enlarged view of A shown in FIG. 3.
Figure 5:
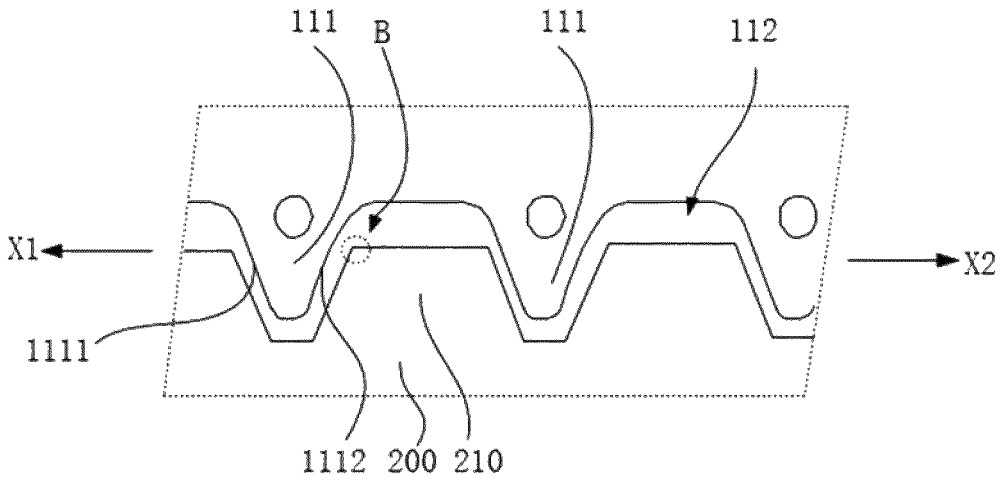
FIG. 5 is a schematic showing the locking device shown in FIG. 1 when the first lock portion is engaged with the transmission portion.

Refer to an embodiment shown in FIG. 4 and FIG. 5, each tooth 111 has, along the tooth thickness, a first surface 1111 and a second surface 1112 opposite to the first surface 1111. The first surface 1111 forms an angle $\alpha_1$, with a direction perpendicular to the moving direction of the first door leaf, in the range of 20°~30°. Preferably, the angle $\alpha_1$ is 23°. The second surface 1112 has a first limitation part in the direction of the moving direction of the first door leaf. The first limitation part can limit the movement of the teeth 210 of the transmission portion 200, so that the teeth 210 of the transmission portion 200 cannot move beyond the second surface 1112 in a direction X1 toward the first surface 1111. The direction X1, that is, the direction from the second surface towards the first surface 1111, is the opening direction of the first door leaf. The first limitation part can limit the teeth 210 of the transmission portion 200 from moving beyond the second surface 1112 towards the first surface 1111. In other words, the first limitation part can limit the teeth 210 of the transmission portion 200 from moving in the opening direction X1 of the first door leaf, which means the first limitation part can limit the transmission part 200 from moving in the opening direction of the first door leaf Therefore, when the first lock portion 110 is engaged with the transmission portion 200, the first limitation part can limit the first door leaf from being opened after it is locked. Therefore, the first lock portion 110 can lock the first door leaf reliably and keep the same in a locked position that is stable and not easily shakable.

In a further embodiment, the second surface 1112 is a concave arc surface which defines the first limitation part. When the first lock portion 110 locks the transmission portion 200, the first lock portion 110 is engaged with the transmission portion 200. The teeth 210 of the transmission portion 200 are engaged between the first teeth 111, and vice versa. If the first door leaf is made to slide by an applied force in the opening direction X1 of the first door leaf, the teeth 210 of the transmission portion 200 may collide with the second surface 1112. Due to the concave of the second surface, a sharp corner B formed at the intersection of the tooth top surface of the tooth 210 and the surface of the tooth 210 close to the second surface 1112 will abut against the second surface 1112, so that the tooth can hardly move beyond the second surface 1112 in the direction X1 towards the first surface 1111. Therefore, in the embodiment where the second surface 1112 is provided in the form of a concave, the transmission portion 200, when locked with the first lock portion 110, can hardly move in the opening direction X1 of the first door leaf. Accordingly, the first lock portion 110 can lock the first door leaf reliably and keep the same in a locked position that is stable and not easily shakable.

In one of the embodiments, the first surface 1111 is a bevel. When the first door leaf is made to slide by an applied force in a closing direction X2 of the first door leaf, the transmission portion 200 moves in the closing direction X2 of the first door leaf as well, and the teeth 210 of the transmission portion 200 may collide with the first surface 1111. Since the first surface 1111 is a bevel, the surface of the tooth 210 close to the first surface 1111 is also made a bevel, so that the first surface 1111 and the surface of the tooth 210 close by can easily slide on each other. Accordingly, the tooth 210 can easily slide over the first surface 1111 and move in the closing direction X2 of the first door leaf Therefore, the first surface 1111, when provided in the form of a bevel, allows the transmission portion 200 to easily move in the closing direction X2 of the first door leaf when the first lock portion 110 is locked with the transmission portion 200.

Figure 1:
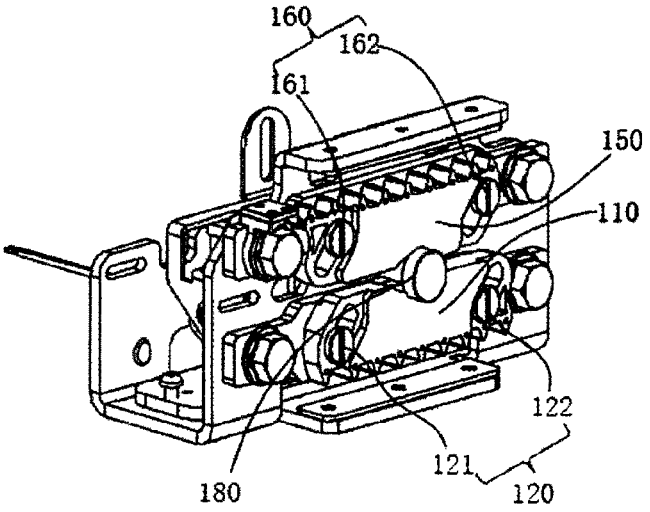
FIG. 1 is a structure diagram of a lock device according to an embodiment of the present disclosure.

Refer to an embodiment as shown in FIG. 1 and FIG. 2, when the first lock portion 110 transfers between the first position and the second position, the first lock portion 110 moves close to or away from the transmission portion 200. When the first lock portion 110 moves close to the transmission portion 200, the first lock portion 110 moves towards the first position so as to lock the transmission portion 200. When the first lock portion moves towards the second position, the first lock portion moves away from the transmission portion 200 so as to release the transmission portion 200. The lock device 100 further comprises a first guiding assembly 120. When the first lock portion 110 moves close to or away from the transmission portion 200, the first guiding assembly 120 is used to guide the movement direction of the first lock portion 110, so that the first lock portion 110 can move to the first position or the second position precisely. As a result, the first lock portion 110 can lock or release the transmission portion 200 precisely.

Referring to an embodiment as shown in FIG. 1 and FIG. 2, the first guiding assembly 120 comprises a first guiding pin 121 and a second guiding pin 122, the positions of both being fixed. In particular, the first guiding pin 121 and the second guiding pin 122 may be fixed on a block through threaded connection. Other ways can also be used to fix the first guiding pin 121 and the second guiding pin 122, which is not specifically limited in this embodiment. The first lock portion 110 is provided with a first guiding slot 113 and a second guiding slot 114, wherein the first guiding pin 121 is located in the first guiding slot 113 and the second guiding pin 122 is located in the second guiding slot 114. Since the positions of the first guiding pin 121 and the second guiding pin 122 are fixed, only the movement of the first lock portion 110 can cause the movements of the first guiding pin 121 and the second guiding pin 122 relative to the first lock portion 110, respectively. Since the first guiding pin 121 is located in the first guiding slot 113 and the second guiding pin 122 is located in the second guiding slot 114, the first guiding pin 121 restricts the first lock portion 110 to only move in a direction parallel to the extending direction of the first guiding slot 113, and the second guiding pin 122 restricts the first lock portion 110 to only move in a direction parallel to the extending direction of the second guiding slot 114. Since the extending direction of the first guiding slot 113 is parallel to that of the second guiding slot 114, the first lock portion 110 can only move in the direction parallel to the extending directions of the first guiding slot 113 and the second guiding slot 114. Accordingly, the first guiding assembly 120 has a function of guiding the movement direction of the first lock portion 110. As a result, when the first lock portion 110 moves in a direction parallel to the extending direction of the first guiding slot 113 and the extending direction of the second guiding slot 114, the first lock portion 110 can move to the first position or second position precisely, thereby precisely locking or releasing the transmission portion 200. Specifically, in this embodiment, the first lock portion 110 has a plurality of alternating first teeth 111 and first tooth sockets. Therefore, the guiding function of the first guiding assembly 120 can guide the movement direction of the first lock portion 110, so that the first lock portion 110 can move to the first position precisely to cause the first lock portion 110 to engage with the transmission portion 200 precisely. Thus, the first lock portion 110 can lock the first door leaf reliably.

Figure 3:
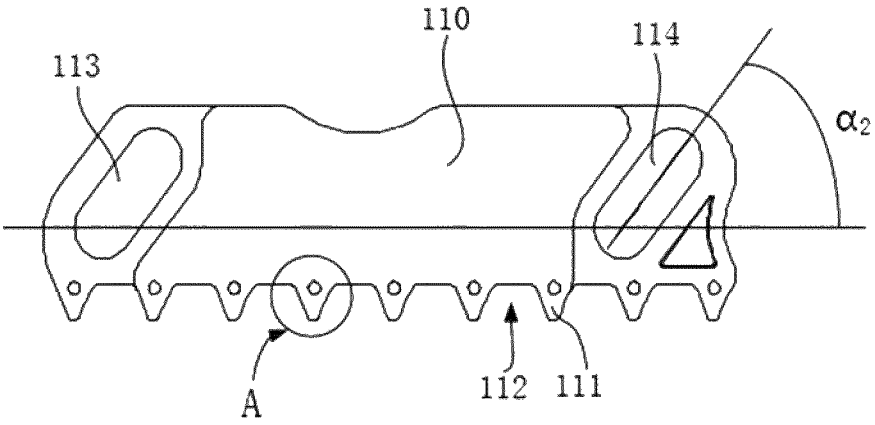
FIG. 3 is a structure diagram of the first locking portion of the locking device shown in FIG. 1.

As shown in FIG. 3, the extending direction of the first guiding slot 113 and the movement direction of the first door leaf form an angle, $\alpha_2$, which could be ranged from 40° to 60°. When the first lock portion 110 locks the transmission portion 200, if the first lock portion 110 is made to move by an applied force in a movement direction of the first door leaf, the first guiding pin 121 and the second guiding pin 122 can block the movement of the first lock portion 110, since the first guiding pin 121 and the second guiding pin 122 can block the inner wall of the first guiding slot 113 and the second guiding slot 114, respectively. As a result, the first lock portion 110 can hardly move in the movement direction of the first door leaf, making it extremely difficult to open the first door leaf Therefore, the first lock portion 110 achieves a good effect of locking. Preferably, when the angle $\alpha_2$ is 50°, the first guiding pin 121 and the second guiding pin 122 can block the movement of the first lock portion 110 with a better effect when the first locking portion 110 locks the transmission portion 200, making it even harder for the first lock portion 110 to move in the movement direction of the first door leaf, thus a good effect of locking of the first lock portion 110.

Figure 6:
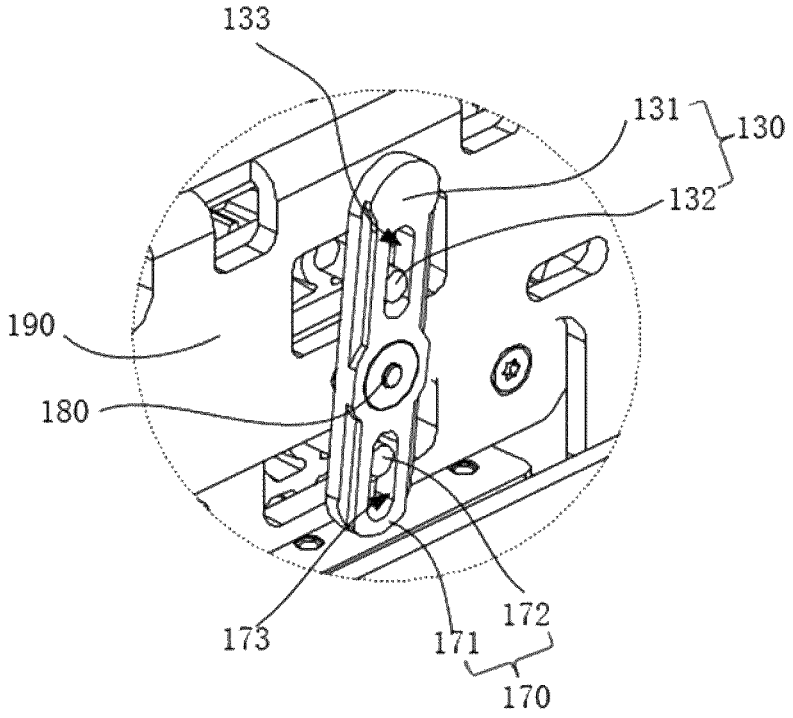
FIG. 6 is a structure diagram of a first linkage assembly and a second linkage assembly of the locking device shown in FIG. 1.

Referring to an embodiment shown in FIG. 6, the lock device further comprises a first linkage assembly 130 which can bring the first lock portion 110 to move with the guiding of the first guiding assembly 120, so that the first lock portion 110 can transfer between the first position and the second position to lock or release the transmission portion 200 precisely.

Again, referring to an embodiment shown in FIG. 6, the first linkage assembly 130 comprises a rotatable first linkage portion 131 and a second linkage portion 132. As an exemplary example, the first linkage portion 131 may be a rotary rod as shown in FIG. 6 and the second linkage portion 132 may be a pin as shown in FIG. 6. The first linkage portion 131 is provided with a fifth guiding slot 133, in which the second linkage portion 132 is located. The second linkage portion 132 is fixedly connected with the first lock portion 110.

When the first linkage portion 131 rotates, the fifth guiding slot 133 also rotates along. Preferably, the rotation direction of the first linkage portion 131 is perpendicular to the extending direction of the fifth guiding slot 133. Since the second linkage portion 132 is located in the fifth guiding slot 133, the second linkage portion 132 can rotate with the rotation of the fifth guiding slot 133. When the first linkage portion 131 rotates, the second linkage portion 132 can also move in the extending direction of the fifth guiding slot 133. Thus, the rotation of the first linkage portion 131 brings the second linkage portion 132 to move. Since the second linkage portion 132 is further fixedly connected with the first lock portion, the movement of the second linkage portion 132 can bring the first lock portion 110 to move, which drives the first lock portion 110 to move. Therefore, the first linkage portion 131 rotates to bring the second linkage portion 132 to move and the second linkage portion 132 brings the first lock portion 110 to move, while the first guiding assembly 120 guides the movement direction of the first lock portion 110. As a result, the first lock portion 110 can move to the first position or the second position precisely, which causes the first lock portion 110 to lock or release the transmission portion 200.

Referring to an embodiment as shown in FIG.1 and FIG.2, the lock device further comprises a second lock portion 150. The transmission portion 200 can drive the movement of a second door leaf 200*b* of the sliding door. The transmission portion 200 can move along the predetermined path relative to the second lock portion 150, so that the transmission portion 200 can bring the sliding door to move along, the predetermined path to open or close the sliding door. The transmission portion 200 has a plurality of successively arranged mating portions for locking with the second lock portion 150. The second lock portion 150 has a third position in which the second lock portion 150 is locked with the transmission portion 200 and a fourth position in which the second lock portion 150 is released from the transmission portion. The transmission portion 200 may be locked in different positions along the predetermined path by matching the second lock portion 150 with different mating portions.

In particular, the second door leaf of the sliding door, as an exemplary example, may move as driven by the transmission portion 200, so as to cause the second door leaf to move in a direction of opening or closing the door. When the second lock portion 150 is in the fourth position, the second lock portion 150 releases the transmission portion 200, so that the transmission portion 200 could move along the predetermined path. The predetermined path means a movement path of the transmission portion 200 when it is driven. Along the predetermined path, the transmission portion 200 may bring the second door leaf to move in the opening or closing direction. When the transmission portion 200 moves along the predetermined path, the plurality of mating portions of the transmission portion 200 move synchronously with the transmission portion 200, so that the different mating portions could pass the second lock portion 150 successively, allowing the different mating portion to match with the second lock portion 150 respectively. When the second lock portion 150 move to the third position, it could match with the mating portions and lock the transmission portion 200. When different mating portions lock with the second lock portion 150, the transmission portion 200 is in different positions of the predetermined path, so that the transmission portion 200 could be locked in different positions of the predetermined path. After the transmission portion 200 is locked, it will no longer be able to drive the second door leaf to move, so that the second door leaf could be locked in any position along the travel range of the second door leaf Therefore, by providing the second lock portion 150, the second door leaf could be locked not only in a fully open position or a fully closed position, but also in any partly-open position of the second door leaf, so that the second door leaf of the sliding door could be locked in the partly-open state stably.

In particular, as an exemplary example, the transmission portion 200 may be a transmission belt, and the second door leaf is fixedly connected to the transmission belt. Accordingly, the transmission belt in motion will drive the movement of, the second door leaf. The second lock portion 150 could comprise a plurality of clips and the mating portions may be in the form of hooks which match with the clips. When the transmission belt moves and brings the second door leaf to move, so will the plurality of hooks on the transmission belt. The second lock portion 150 can lock different hooks on the transmission belt via the clips, to inhibit the transmission belt from moving, thereby locking the second door leaf in different positions. As a result, it is possible to lock the second door leaf in any position along the travel range of the second door leaf.

In one of the embodiments, the transmission portion 200 is an annular transmission belt and is fixedly connected with the first door leaf and the second door leaf, respectively. When the annular transmission belt moves, the annular transmission belt can reciprocate along the circumferential direction of the annular transmission belt. As a result, the first door leaf and the second leaf door can move simultaneously when the transmission portion 200 moves, and be locked simultaneously when the transmission portion 200 is locked.

In one of the embodiments, the transmission portion 200 comprises a first portion and a second portion independent of each other. Particularly, the first portion and the second portion may be transmission belts independent of each other. The movement of the first portion can bring the first door leaf to move. When the first portion brings the first door leaf to move to different positions, the first portion can match with the first lock portion 110, so that the first lock portion 110 locks the first portion, thereby locking the first door leaf. The movement of the second portion can bring the second door leaf to move. When the second portion brings the second door leaf to move to different positions, the second portion can match with the second lock portion 150, so that the second locks portion 150 lock the second portion, thereby locking the second door leaf. The locking state of the first door leaf and the second door leaf could be independent of each other due to the independent movements of the first portion and the second portion.

In one of the embodiments, the transmission portion 200 can bring the mating portions to move relative to the second lock portion 150 along the straight path. That is to say, the second door leaf can move along the straight path together with the transmission portion 200. The second lock portion 150 can move along a path which is at an angle with the straight path. Due to the angle formed between the movement paths of the first lock portion 110 and the transmission portion 200, which could be a sharp angle or an obtuse angle, the second lock portion 150 may move towards or away from the transmission portion 200, causing the second lock portion 150 to lock with or separate from the mating portions, and thus lock or release the transmission portion 200. Since the transmission portion 200 can bring the mating portions to move relative to the second lock portion 150 along the straight path, several different mating portions can pass the second lock portion 150 successively, so that the different mating portions can match with the second lock portion 150. When different mating portions match with the second lock portion 150, the transmission portion 200 is located in different positions of the predetermined path, so that the transmission portion 200 could be locked in different positions of the predetermined path.

In one of the embodiments, the second lock portion 150 and the mating portions can match each other in the way of one-way relative motion. In other words, when the second lock portion 150 matches with the mating portions, the mating portions can move in a single direction relative to the second lock portion 150. The single direction may be a direction in which the second door leaf closes. In other words, when the second lock portion 150 marches with the mating portions, the mating portions can only move along a closing direction of the second door leaf and cannot move along the opening direction of the second door leaf, so that the sliding door cannot be opened when locked, providing a good function of thievery and robbery prevention.

Referring to an embodiment shown in FIG. 2, the mating portions comprise a plurality of teeth 210 and tooth sockets between adjacent teeth 210. The second lock portion 150 comprises a plurality of second teeth 151, with a second tooth socket 152 formed between adjacent second teeth 151. When the second lock portion 150 is in the fourth position, the second lock portion 150 is separated from the transmission portion 200, releasing the transmission portion 200, to cause the transmission portion 200 to move along the predetermined path. When the transmission portion 200 moves along the predetermined path, the teeth 210 and the tooth sockets of the transmission portion 200 move as well. When the second lock portion 150 moves to the third position, the second lock portion 150 is engaged with the transmission portion 200, so that the teeth 210 of the transmission portion 200 can be blocked by the second teeth 151, thereby locking the transmission 200. Since the transmission portion 200 can move along the predetermined path, the different teeth 210 of the transmission portion 200 can pass the second lock portion 150 successively to be engaged with the second lock portion 150. When different teeth 210 are engaged with the second lock portion 150, the transmission portion 200 may be locked in different positions. By providing a plurality of second teeth 151 and second tooth sockets 152 of the second lock portion 150, the second lock portion 150 can be engaged with the transmission portion 200, which facilitate the second teeth 151 to block the teeth 210 of the transmission portion 200 so as to lock the transmission portion 200, thereby locking the first door leaf of the sliding door. By using the transmission belt with teeth 210 and tooth sockets as the transmission portion 200, when the transmission portion 200 moves, the plurality of teeth of the transmission portion 200 can pass the second lock portion 150 successively to lock the transmission portion 200 in different positions.

In one of the embodiments, each second tooth 151 has, along the tooth thickness, a third surface and a fourth surface opposite to the third surface. The third surface forms an angle with the direction perpendicular to the moving direction of the second door leaf, which could be in the range of 20°~30°. Preferably, the angle is 23°. The fourth surface has a second limitation part in the direction of the moving direction of the second door leaf. The second limitation part can limit the movement of the teeth 210 of the transmission portion 200, so that the teeth 210 of the transmission portion 200 cannot move beyond the fourth surface in a movement direction toward the third surface. The direction from the fourth surface towards the third surface is the opening direction of the second door leaf. The second limitation part could limit the teeth 210 of the transmission portion 200 from moving beyond the fourth surface towards the third surface. In other words, the first limitation part could limit the teeth 210 of the transmission portion 200 from moving in the opening direction of the second door leaf, which means the second limitation part can limit the transmission part 200 from moving in the opening direction of the second door leaf Therefore, when the second lock portion 150 is engaged with the transmission portion 200, the second limitation part can limit the second door leaf from being opened after it is locked. Therefore, the second lock portion 150 can lock the second door leaf reliably and the second door leaf could be kept in the locked position stably and cannot be easy to shake.

In a further embodiment, the fourth surface is a concave arc surface, which defines the second limitation part. When the second lock portion 150 locks the transmission portion 200, the second lock portion 150 is engaged with the transmission portion 200. The teeth 210 of the transmission portion 200 are engaged between the second teeth 151, and vice versa. If the second door leaf is made to slide by an applied force in the opening direction of the second door leaf, the teeth 210 of the transmission portion 200 may collide with the fourth surface. Due to the concave of the fourth surface, a sharp corner B formed at the intersection of the tooth top surface of the tooth 210 and the surface of the tooth 210 close to the fourth surface will abut against the fourth surface, so that the tooth 210 can hardly move beyond the fourth surface in the direction towards the third surface. Therefore, in the embodiment where the fourth surface is provided in the form of a concave, the transmission portion 200, when locked with the second lock portion 150, can hardly move in the opening direction of the second door leaf. Accordingly, the second lock portion 150 can lock the second door leaf reliably and keep the same in a locked position that is stable and not easily shakable.

In one of the embodiments, the third surface is a bevel. When the second door leaf is made to slide by an applied force in a closing direction of the second door leaf, the transmission portion 200 moves in the closing direction of the second door leaf as well, and the teeth 210 of the transmission portion 200 may collide with the third surface. Since the third surface is a bevel, the surface of the tooth 210 close to the third surface is also made a bevel, so that the third surface and the surface of the tooth 210 close by can easily slide on each other. Accordingly, the tooth 210 can easily slide over the third surface and move in the closing direction of the second door leaf Therefore, the third surface, when provided in the form of a bevel, allows the transmission portion 200 to easily move in the closing direction of the first door leaf when the second lock portion 150 is locked with the transmission portion 200.

In one of the embodiments, when the second lock portion 150 transfers between the third position and the fourth position, the second lock portion 150 moves close to or away from the transmission portion 200. When the second lock portion 150 moves close to the transmission portion 200, the second lock portion 150 moves towards the third position to lock the transmission portion 200. When the second lock portion 150 moves towards the fourth position, the second lock portion 150 moves away from the transmission portion 200 to release the transmission portion 200. The lock device 100 further comprises a second guiding assembly 160. When the second lock portion 150 moves close to or away from the transmission portion 200, the second guiding assembly 160 is used to guide the movement direction of the second lock portion 150, so that the second lock portion 150 could move to the third position or the fourth position precisely. As a result, the second lock portion 150 can lock or release the transmission portion 200 precisely.

Referring to FIG. 1 and FIG. 2, in an embodiment, the second guiding assembly 160 comprises a third guiding pin 161 and a fourth guiding pin 162, the positions of both being fixed. In particular, the third guiding pin 161 and the fourth guiding pin 162 may be fixed on a block through threaded connection. Other ways can also be used to fix the third guiding pin 161 and the fourth guiding pin 162, which is not specifically limited in this embodiment. The second lock portion 150 is provided with a third guiding slot 153 and a fourth guiding slot 154, wherein the third guiding pin 161 is located in the third guiding slot 153 and the fourth guiding pin 162 is located in the fourth guiding slot 154. Since the positions of the third guiding pin 161 and the fourth guiding pin 162 are fixed, only the movement of the second lock portion 150 can cause the movements of the third guiding pin 161 and the fourth guiding pin 162 relative to the second lock portion 150 respectively. Since the third guiding pin 161 is located in the third guiding slot 153 and the fourth guiding pin 162 is located in the fourth guiding slot 154, the third guiding pin 161 restricts the second lock portion 150 to only move in a direction parallel to the extending direction of the third guiding slot 153, and the fourth guiding pin 162 restricts the second lock portion 150 to only move in a direction parallel to the extending direction of the fourth guiding slot 154. Since the extending direction of the third guiding slot 153 is parallel to that of the fourth guiding slot 154, the second lock portion 150 can only move in the direction parallel to the extending directions of the third guiding slot 153 and the fourth guiding slot 154. Accordingly, the second guiding assembly 160 has a function of guiding the movement direction of the second lock portion 150. As a result, when the second lock portion 150 moves in a direction parallel to the extending direction of the third guiding slot 153 and the extending direction of the fourth guiding slot 154, the second lock portion 150 can move to the third position or fourth position precisely, thereby precisely locking or releasing the transmission portion 200. Specifically, in this embodiment, the second lock portion 150 has a plurality of alternating second teeth 151 and second tooth sockets 152. Therefore, the guiding function of the second guiding assembly 160 can guide the movement direction of the second lock portion 150, so that the second lock portion 150 can move to the third position precisely to cause the second lock portion 150 to engage with the transmission portion 200 precisely. Thus, the second lock portion 150 can lock the second door leaf reliably.

The extending direction of the third guiding slot 153 and the movement direction of the first door leaf form an angle which could be ranged from 40° to 60°. When the second lock portion 150 locks the transmission portion 200, if the second lock portion 150 is made to move by an applied force in a movement direction of the second door leaf, the third guiding pin 161 and the fourth guiding pin 162 can block the movement of the second lock portion 150, since the third guiding pin 161 and could block the fourth guiding pin 162 could block the inner wall of the third guiding slot 153 and the fourth guiding slot 154, respectively. As a result, the second lock portion 150 can hardly move in the movement direction of the second door leaf, making it extremely difficult to open the first door leaf Therefore, the second lock portion 150 achieves a good effect of locking. Preferably, when the angle is 50°, the third guiding pin 161 and the fourth guiding pin 162 can block the movement of the second lock portion 150 with a better effect when the second locking portion 150 locks the transmission portion 200, making it even harder for the second lock portion 150 to move in the direction of the movement direction of the second door leaf, thus a good effect of locking of the second lock portion 150.

Referring to an embodiment shown in FIG. 6, the lock device 100 further comprises a second linkage assembly 170 which can bring the second lock portion 150 to move with the guiding of the second guiding assembly 160, so that the second lock portion 150 can transfer between the third position and the fourth position to lock or release the transmission portion 200 precisely.

Again, referring to an embodiment shown in FIG. 6, the second linkage assembly 170 comprises a rotatable third linkage portion 171 and a fourth linkage portion 172. As an exemplary example, the third linkage portion 171 may be a rotary rod as shown in FIG. 6 and the fourth linkage portion 172 may be a pin as shown in FIG. 6. The third linkage portion 171 is provided with a sixth guiding slot 173 in which the fourth linkage portion 172 is located. The fourth linkage portion 172 is fixedly connected with the second lock portion 150.

When the third linkage portion 171 rotates, the sixth guiding slot 173 also rotates along. Preferably, the rotation direction of the third linkage portion 171 is perpendicular to the extending direction of the sixth guiding slot 173. Since the fourth linkage portion 172 is located in the sixth guiding slot 173, the fourth linkage portion 172 can rotate with the rotation of the sixth guiding slot 173. When the third linkage portion 171 rotates, the fourth linkage portion 172 can also move in the extending direction of the sixth guiding slot 173. Thus, the rotation of the third linkage portion 171 brings the fourth linkage portion 172 to move. Since the fourth linkage portion 172 is further fixedly connected with the second lock portion 150, the movement of the fourth linkage portion 172 can bring the second lock portion 150 to move, which drives the second lock portion 150 to move. Therefore, the third linkage portion 171 rotates to bring the fourth linkage portion 172 to move and the fourth linkage portion 172 brings the second lock portion 150 to move while the second guiding assembly 160 guides the movement direction of the second lock portion 150. As a result, the second lock portion 150 can move to the third position or the fourth position precisely, which causes the second lock portion 150 to lock or release the transmission portion 200.

In this embodiment, the surface of the second lock portion 150 close to the transmission portion of the second door leaf is located on a side of the second lock portion 150 which is away from the first lock portion 110. The surface of the first lock portion 110 close to the transmission portion 200 is located on a side of the first lock portion 110 which is away from the second locking portion 150. In other words, when the first lock portion 110 moves close to the transmission portion 200, the first lock portion 110 moves in a direction away from the second lock portion 150. When the second lock portion 150 moves close to the transmission portion 200, the second lock portion 150 moves in a direction away from the first lock portion 110. In other words, when the first lock portion 110 locks with the transmission portion 200 and the second lock portion 150 locks with the transmission portion 200, the movement direction of the first lock portion 110 is opposite to that of the second lock portion 150.

In other embodiments, the surface of the second lock portion 150 close to the transmission portion of the second door leaf may also be located on a side of the second lock portion 150 which is close to the first lock portion 110. The surface of the first lock portion 110 close to the transmission portion 200 may also be located on the side of the first lock portion 110 which is close to the second locking portion 150.

Referring to FIG. 1 and FIG. 6, in one of the embodiments, the lock device 100 further comprises a first pin 180. The first linkage portion 131 is fixedly connected with the third linkage portion 171. The first linkage portion 131 and the third linkage portion 171 may be a rotary bar that is integrally formed. Therefore, when the first linkage portion 131 moves, the third linkage portion 171 moves synchronously with the first linkage portion 131. Since the fifth guiding slot 133 is located on one side of the first pin 180 while the sixth guiding slot 173 is located on the other side of the first pin 180, the fifth guiding slot 133 and the sixth guiding slot 173 have the same extending direction. Therefore, when the first linkage portion 131 and the third linkage portion 171 rotate about the first pin 180 respectively, the second linkage portion 132 and the fourth linkage portion 172 have opposite movement directions, and in turn opposite movement directions of the first lock portion 110 and the second lock portion 150. Therefore, when the first linkage portion 131 and the third linkage portion 171 are rotated, the first lock portion 110 and the second lock portion 150 can simultaneously move in opposite directions. Therefore, when the first lock portion 110 locks the first door leaf, the second lock portion 150 locks the second door leaf at the same time. Similarly, when the first lock portion 110 releases the first door leaf, the second lock portion 150 releases the second door leaf at the same time.

Refer to FIG. 6, in one of the embodiments, the lock device 100 further comprises a first supporting portion 190, wherein the first pin 180 is adjustably connected with the first supporting portion 190. The first pin 180 has an adjustable position on the first supporting portion, so that it is possible to adjust the positions of the first linkage portion 131 and the third linkage portion 171 in order to adjust the positions of the first lock portion 110 and the second lock portion 150. In particular, the position of the first pin 180 in a movement direction of the first door leaf may be adjusted, so as to allow the first lock portion 110 to be engaged with the transmission portion 200 precisely. Also, the position of the first pin 180 in a movement direction of the second door leaf may be adjusted, so as to allow the second lock portion 150 to be engaged with the transmission portion 200 precisely.

In particular, the first supporting portion 190 may be provided with a seventh guiding slot, the extending direction of which being parallel to the sliding direction of the first door leaf and the second door leaf. The first pin 180 is located in the seventh guiding slot. By moving the first pin 180 along the extending direction of the seventh guiding slot, the position of the first pin 180 in the sliding direction of the first door leaf and the second door leaf may be adjusted, so that the first lock portion 110 and the second lock portion 150 can be precisely engaged with the transmission portion 200, respectively.

In one of the embodiments, the lock device 100 further comprises a driving portion (not shown) configurated to drive the first linkage portion 131 and the third linkage portion 171 to rotate. In particular, the driving portion may be a solenoid valve.

In one of the embodiments, the type of locking may be fail safe locking, fail secure locking, or bi-stable locking.

A system for sliding door is provided in one embodiment, which comprises a lock device 100 as in any embodiment mentioned above, One or more door leaves are fixedly connected with a transmission portion 200 of the sliding door system. The lock device 100 comprises a first lock portion 110 and the transmission portion 200. The transmission portion may move relative to the first lock portion 110 along the predetermined path, so that the transmission portion 200 may bring the sliding door to move along the predetermined path to open or close the sliding door. The transmission portion 200 has a plurality of successively arranged mating portions which can lock with the first lock portion 110. The first lock portion 110 has a first position in which the first lock portion 110 is locked with the transmission portion 200 and a second position in which the first lock portion 110 is released from the transmission portion 200. The transmission portion 200 may be locked in different positions along the predetermined path by matching the first lock portion 110 with different mating portions. By providing the first lock portion 110 and the transmission portion 200 as such, the sliding door may be locked not only in its open and closed position, but also in any partly-open position of the sliding door. Therefore, the sliding door may be locked in the partly-open state stably.

The technical features in the embodiments mentioned above may be combined in any combination. In order to make the description concise, all possible combinations of the technical features in the embodiments mentioned above are not described. However, as long as there is no conflict between the combinations of the technical features, all possible combinations of the technical features should be considered to fall into the scope of protection of the present disclosure.

The embodiments mentioned above merely present several embodiments of the present disclosure, which are described more specifically and in detail, but it should not be construed as the limiting to the scope of the present disclosure. It should be noted that those skilled in the art may make various modifications and improvements without departing from the concept of the present disclosure, all of which fall into the scope of protection of the present disclosure. Therefore, the scope of protection of the present disclosure shall be subject to the appended claims.

The invention claimed is:

1. A lock device for locking a sliding door, the lock device comprising:

a first lock portion; and a transmission portion, wherein, the transmission portion is used to drive a first door leaf of the sliding door to move and is capable of moving relative to the first lock portion along a predetermined path;

wherein the transmission portion has a plurality of successively arranged mating portions for locking with the first lock portion, wherein the first lock portion is locked with the transmission portion in a first position, wherein the first lock portion is released from the transmission portion in a second position; and wherein the transmission portion is able to be locked in a plurality of different positions along the predetermined path by matching the first lock portion with different mating portions.

2. The lock device of claim 1, wherein the transmission portion moves the mating portions along a straight path relative to the first lock portion, wherein the first lock portion moves along a path at an angle with the straight path, and wherein the first lock portion is locked with or released from the mating portions by motion of the first lock portion.

3. The lock device of claim 2, wherein the first lock portion transfers between the first position and the second position by motion close to or away from the transmission portion; wherein the lock device further comprises a first guiding assembly, and wherein the first guiding assembly is used to guide the first lock portion to move close to or away from the transmission portion.

4. The lock device of claim 3, wherein the first guiding assembly comprises a first guiding pin and a second guiding pin, positions of the first guiding pin and the second guiding pin being fixed;

wherein the first lock portion is provided with a first guiding slot and a second guiding slot, wherein the first guiding pin is located in the first guiding slot and the second guiding pin is located in the second guiding slot; wherein an extending direction of the first guiding slot is parallel to that of the second guiding slot;

wherein the first guiding pin and the second guiding pin are able to guide a movement of the first lock portion, and wherein motion of the first guiding pin in the extending direction of the first guiding slot relative to the first lock portion and motion of the second guiding pin in the extending direction of the second guiding slot relative to the first lock portion, moves the first lock portion close to or away from the transmission portion.

5. The lock device of claim 4, wherein an angle formed between the extending direction of the first guiding slot and the movement direction of the transmission portion ranges from 40° to 60°.

6. The lock device of claim 5, wherein the angle formed between the extending direction of the first guiding slot and the movement direction of the transmission portion is 50°.

7. The lock device of claim 3, further comprising a first linkage assembly connected with the first guiding assembly to move the first lock portion under guidance of the first guiding assembly.

8. The lock device of claim 7, wherein the first linkage assembly comprises a rotatable first linkage portion and a second linkage portion, wherein the first linkage portion is provided with a fifth guiding slot, wherein the second linkage portion is located in the fifth guiding slot, the second linkage portion being fixedly connected with the first lock portion; wherein rotation of the first linkage portion causes the second linkage portion to move along, the extending direction of the fifth guiding slot relative to the first linkage portion, and wherein the first lock portion moves under guidance of the first guiding assembly.

9. The lock device of claim 8, wherein the transmission portion is used to drive a second door leaf of the sliding door to move;

wherein the lock device further comprises a second lock portion, wherein the transmission portion is able to move relative to the second lock portion along the predetermined path, wherein the transmission portion has a further plurality of successively arranged mating portions for locking with the second lock portion, and the second lock portion has a third position such that the second lock portion is locked with the transmission portion and a fourth position such that the second lock portion is released from the transmission portion; and the transmission portion is able to be locked in a further plurality of different positions along the predetermined path by matching the second lock portion with the further plurality of different mating portions.

10. The lock device of claim 9, wherein the transmission portion is an annular transmission belt; or the transmission portion comprises a first portion and a second portion independent of each other, wherein the first portion is used to match with the first lock portion and the second portion is used to match with the second lock portion.

11. The lock device of claim 9, wherein the transmission portion is able to bring the further plurality of mating portions to move relative to the second lock portion along a further straight path, and the second lock portion is able to move along a further path at an angle with the further straight path, so that the second lock portion is able to be locked with or released from the mating portions.

12. The lock device of claim 9, wherein the second lock portion and the further plurality of mating portions are able to match with each other in a form of one-way relative motion, wherein, in the third position, the second lock portion matched with the mating portions and the mating portions move along a single direction relative to the second lock portion.

13. The lock device of claim 9, wherein the second lock portion comprises a plurality of second teeth and the second tooth sockets formed between the adjacent second teeth, wherein the second teeth and the second tooth sockets are able to be engaged with corresponding tooth sockets and corresponding teeth of the transmission portion, respectively, so that the transmission portion is locked.

14. The lock device of claim 13, wherein each of the second teeth has, along a second tooth thickness, a third surface and a fourth surface opposite to the third surface in the direction of second tooth thickness, wherein the third surface forms an angle with a direction perpendicular to a movement direction of the second door leaf ranged from 20° to 30°; and the fourth surface has a second limitation part in the movement direction of the second door leaf, the second limitation part being used to limit the movement of the second teeth.

15. The lock device of claim 14, wherein an angle formed between the third surface and the direction perpendicular to the sliding direction of the second door leaf is 23°.

16. The lock device of claim 8, wherein the second lock portion transfers between the third position and the fourth position by motion close to or away from the transmission portion; and, the lock device further comprises a second guiding assembly, the second guiding assembly being used to guide the second lock portion to move close to or away from the transmission portion.

17. The lock device of claim 16, further comprising a second linkage assembly adapted to move the second lock portion guided by the second guiding assembly.

18. The lock device of claim 17, wherein the second linkage assembly comprises a rotatable third linkage portion and a fourth linkage portion, wherein the third linkage portion is provided with a sixth guiding slot in which sixth guiding slot the fourth linkage portion is located, the fourth linkage portion being fixedly connected with the second lock portion; wherein rotation of the third linkage portion moves the fourth linkage portion in the extending direction of the sixth guiding slot relative to the third linkage portion, and wherein the second lock portion moves with the guiding of the second guiding assembly.

19. The lock device of claim 18, wherein the lock device further comprises a first pin, wherein the first linkage portion is fixedly connected with the third linkage portion, wherein the fifth guiding slot is located on one side of the first pin and the sixth guiding slot is located on the other side of the first pin, wherein the fifth guiding slot and the sixth guiding slot have the same extending directions; wherein rotation of first linkage portion and the third linkage portion about the first pin moves the second linkage portion and the fourth linkage portion in opposite directions simultaneously to lock the first lock portion with the transmission portion and to lock the second lock portion with the transmission portion simultaneously.

20. The lock device of claim 19, wherein the lock device further comprises a first supporting portion, wherein the first pin is provided on the first supporting portion; wherein a position of the first pin on the first supporting portion is adjustable, allowing adjusting the positions of the first linkage portion and the third linkage portion so as to adjust the positions of the first lock portion and the second lock portion.

21. The lock device of claim 18, wherein the lock device further comprises a driving portion used to drive the first linkage portion and the third linkage portion to rotate.

22. The lock device of claim 18, wherein the first linkage portion and the third linkage portion are formed integrally.

23. The lock device of claim 21, wherein the driving portion is a solenoid valve.

24. The lock device of claim 8, wherein the second guiding assembly comprises a third guiding pin and a fourth guiding pin, wherein the positions of the third guiding pin and the fourth guiding pin are fixed;

wherein the second lock portion is provided with a third guiding slot and a fourth guiding slot, wherein the third guiding pin is located in the third guiding slot and the fourth guiding pin is located in the fourth guiding slot; wherein the extending direction of the third guiding slot is parallel to that of the fourth guiding slot;

wherein the third guiding pin and the fourth guiding pin are able to guide the movement of the second lock portion to move the third guiding pin in the extending direction of the third guiding slot relative to the second lock portion and to move the fourth guiding pin in the extending direction of the fourth guiding slot relative to the second lock portion, and wherein the second lock portion moves close to or away from the transmission portion.

25. The lock device of claim 24, wherein an angle formed between the extending direction of the third guiding slot and the movement direction of the transmission portion ranges from 40° to 60°.

26. The lock device of claim 25, wherein the angle formed between the extending direction of the third guiding slot and the sliding direction of the transmission portion is 50°.

27. The lock device of claim 1 wherein the first lock portion and the mating portions are able to match with each other in a form of one-way relative motion, wherein, in the first position, the first lock portion is matched with the mating portions and the mating portions move along a single direction relative to the first lock portion.

28. The lock device of claim 1, wherein the first lock portion comprises a plurality of first teeth and first tooth sockets formed between the adjacent first teeth, wherein the first teeth and the first tooth sockets are able to be engaged with corresponding tooth sockets and corresponding teeth of the transmission portion, respectively, so that the transmission portion is locked.

29. The lock device of claim 28, wherein each of the first teeth has, along a tooth thickness, a first surface and a second surface opposite to the first surface, wherein the first surface forms an angle with a direction perpendicular to a movement direction of the first door leaf in the range of 20°~30°; and, the second surface has a first limitation part in the movement direction of the first door leaf, the first limitation part being used to limit the movement of the transmission portion.

30. The lock device of claim 29, wherein the angle between the first surface and the direction perpendicular to the movement direction of the first door leaf is 23°.

31. The lock device of claim 1, wherein a type of locking is able to be:

fail-safe locking, fail secure locking or bi-stable locking.

32. A sliding door system, comprising the lock device of claim 1, wherein one or more door leaves are fixedly connected to the transmission portion.

* * * * *